US009903635B2

(12) United States Patent
Eicher et al.

(10) Patent No.: US 9,903,635 B2
(45) Date of Patent: Feb. 27, 2018

(54) DOMESTIC REFRIGERATION APPLIANCE WITH A KEEP-FRESH CONTAINER THE FRONT WALL OF WHICH IS AN OUTER WALL OF THE APPLIANCE

(71) Applicant: BSH HAUSGERÄTE GmbH, München (DE)

(72) Inventors: Max Eicher, München (DE); Christine Hartwein, München (DE); Klaus Försterling, Amerang (DE); Christoph Becke, Grosskarolinenfeld (DE); Boris Angele, Diessen (DE)

(73) Assignee: BSH Hausgeräte GmbH, Munich (DE)

( * ) Notice: Subject to any disclaimer, the term of this patent is extended or adjusted under 35 U.S.C. 154(b) by 0 days.

(21) Appl. No.: 15/347,988

(22) Filed: Nov. 10, 2016

(65) Prior Publication Data

US 2017/0131016 A1 May 11, 2017

(30) Foreign Application Priority Data

Nov. 11, 2015 (DE) ..... 10 2015 222 229

(51) Int. Cl.

| | |
|---|---|
| ***A47B 96/04*** | (2006.01) |
| ***F25D 17/04*** | (2006.01) |
| ***F25D 25/02*** | (2006.01) |
| *F25D 23/02* | (2006.01) |

(52) U.S. Cl.

CPC ..... *F25D 17/042* (2013.01); *F25D 25/021* (2013.01); *F25D 25/025* (2013.01); *F25D 23/021* (2013.01); *F25D 2317/0413* (2013.01); *F25D 2317/04131* (2013.01)

(58) Field of Classification Search

CPC .... F25D 17/042; F25D 25/021; F25D 25/025; F25D 2317/0413; F25D 2317/04131

See application file for complete search history.

(56) References Cited

U.S. PATENT DOCUMENTS

| | | | | |
|---|---|---|---|---|
| 2,246,342 A | | 6/1941 | Brown | |
| 2,724,628 A | * | 11/1955 | Schrader | F25D 25/021 312/270.3 |
| 2,801,146 A | * | 7/1957 | Mikulas | F25D 25/021 312/301 |
| 2,894,845 A | * | 7/1959 | Stoddard | A23B 7/0425 426/419 |

(Continued)

FOREIGN PATENT DOCUMENTS

| | | | | |
|---|---|---|---|---|
| DE | 40 40 341 | | 7/1992 | |
| DE | 102005036062 A1 | * | 2/2007 | A47B 88/41 |

(Continued)

*Primary Examiner* — Hanh V Tran

(74) *Attorney, Agent, or Firm* — Nixon & Vanderhye, P.C.

(57) ABSTRACT

A domestic refrigeration appliance with an interior compartment for accommodating foodstuffs which is bounded by walls of an interior container and with a keep-fresh container for foodstuffs in which an ambient humidity different from that of the interior compartment can be set and the ambient humidity can be set independently of the rest of the interior compartment, wherein the keep-fresh container is arranged displaceably in a housing of the domestic refrigeration appliance, wherein a front wall of the keep-fresh container forms an outer wall of the domestic refrigeration appliance.

15 Claims, 4 Drawing Sheets

(56) References Cited

Figure 1:
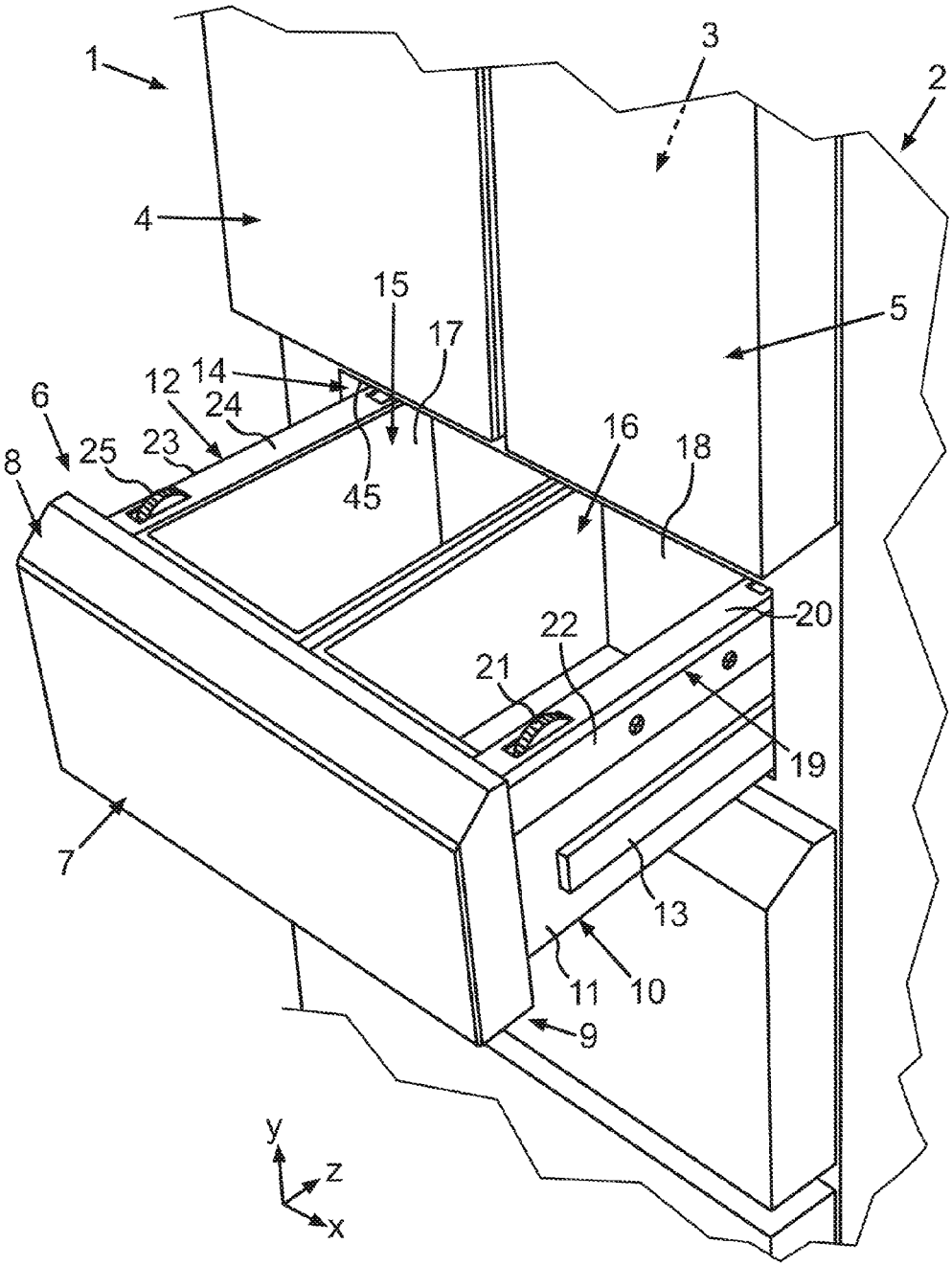

U.S. PATENT DOCUMENTS 4,788,832 A * 12/1988 Aoki ..... F25D 17/065 62/382
4,850,206 A * 7/1989 Larsen ..... F25D 17/04 62/382
5,226,707 A * 7/1993 Han ..... A47B 77/16 312/246
5,417,080 A * 5/1995 Bishop ..... A23B 7/00 312/402
5,918,480 A * 7/1999 Nagata ..... A23B 7/0425 215/310
8,590,993 B2 * 11/2013 Lee ..... F25D 25/025 312/270.3
9,353,989 B2 * 5/2016 Furr ..... F25D 25/025
2006/0016210 A1 * 1/2006 Lee ..... F25D 17/045 62/408
2007/0262686 A1 * 11/2007 Ji ..... A47B 88/00 312/402
2007/0271948 A1 * 11/2007 Grobleben ..... F25D 25/005 62/382
2008/0265733 A1 * 10/2008 Hue ..... F25D 25/025 312/404
2011/0023530 A1 * 2/2011 An ..... F25D 25/025 62/449
2011/0259036 A1 * 10/2011 Lim ..... F25C 1/24 62/344
2013/0221824 A1 * 8/2013 Jeon ..... F25D 23/00 312/404
2013/0300276 A1 * 11/2013 Nuss ..... F25D 25/021 312/404
2014/0265802 A1 * 9/2014 Wilcox ..... F25D 25/025 312/404
2014/0300264 A1 * 10/2014 Park ..... F25D 25/025 312/404
2014/0312758 A1 * 10/2014 Gossens ..... F25D 23/04 312/404
2015/0028026 A1 * 1/2015 Rajasekaran ..... F25D 25/025 220/4.03
2015/0300724 A1 * 10/2015 Becke ..... F25D 25/025 312/405
2016/0153699 A1 * 6/2016 Lee ..... F25D 25/025 312/404
2016/0153704 A1 * 6/2016 Burke ..... F25D 25/025 312/404
2016/0265816 A1 * 9/2016 Gillette ..... F25D 25/025
2016/0320118 A1 * 11/2016 Millett ..... F25D 31/005
2016/0341469 A1 * 11/2016 Hanson ..... F25D 25/025

FOREIGN PATENT DOCUMENTS

DE 102009002645 A1 * 10/2010 ..... F25D 25/025
DE 102009029141 * 3/2011
DE 102012221496 A1 * 5/2014
EP 2 453 190 A1 5/2012
JP 200088432 A * 3/2000
JP 2004150763 A * 5/2004
KR 10-2009-0133008 A 12/2009
WO WO 2011/026749 3/2011
WO WO 2015/082279 A1 6/2015

* cited by examiner

DOMESTIC REFRIGERATION APPLIANCE WITH A KEEP-FRESH CONTAINER THE FRONT WALL OF WHICH IS AN OUTER WALL OF THE APPLIANCE

This application claims priority to DE Patent Application No. 102015222229.2 filed Nov. 11, 2016, the entire content of which is hereby incorporated by reference.

The invention relates to a domestic refrigeration appliance with an interior compartment for accommodating foodstuffs which is bounded by walls of an interior container. The domestic refrigeration appliance also comprises a keep-fresh container for foodstuffs in which a different ambient humidity or a different humidity level from that of the interior compartment can be set and this can take place independently of the rest of the interior compartment. The keep-fresh container is arranged displaceably in a housing of the domestic refrigeration appliance.

Embodiments of this kind are known from the prior art. For example, WO 2011/026749 A2 describes a refrigeration appliance of this kind with a vegetable box. A drawer to accommodate vegetables can be inserted into and removed from the interior compartment. The top of this drawer can be covered by a cover. The cover lies on obliquely inclined upper edges of the drawer in closed state. Arranged above the cover, there is a further plate on which a front strip is embodied on which a control element is positioned in displaceable manner. The control element can be displaced in parallel to the front strip and to this end is coupled to an obliquely aligned guide in the form of a slot, which is embodied in the cover. In dependence on the displacement of this slide, the cover is then raised, said cover being coupled by a corresponding mechanical coupling to the plate arranged thereabove.

Also known from DE 40 40 341 C2 is a keep-fresh box with a closable cover. This box can also be inserted in an interior compartment of a domestic refrigeration appliance.

With the two embodiments known from the prior art, it is provided that the goods introduced to be cooled, for example in the form of vegetables, salads, meat, fruit and the like are protected from unwanted rapid drying out. The problems that occur in this context are explained adequately in DE 40 40 341 C2.

With domestic refrigeration appliances, the keep-fresh container is completely arranged in the interior compartment which is covered by a separate door, which is embodied independently of the keep-fresh container and is moveable. Therefore, access to the interior of the keep-fresh container requires several actions on the part of a user and the actuation of the separate door to the keep-fresh container.

It is the object of the present invention to provide a domestic refrigeration appliance with improved access to the keep-fresh container.

This object is achieved by a domestic refrigeration appliance with the features of claim 1.

A domestic refrigeration appliance according to the invention comprises an interior compartment for accommodating foodstuffs which is bounded by walls of an interior container. The domestic refrigeration appliance also comprises a keep-fresh container for foodstuffs, in which by definition a different ambient humidity or a different humidity level, and hence atmospheric humidity, from that of the interior compartment can be set and this can take place independently of the rest of the interior compartment. The keep-fresh container is a refrigerating compartment in which foodstuffs can be stored at a temperature higher than 0°. The humidity level can in particular be set individually by a humidification apparatus in the domestic refrigeration appliance, which generates humidity and controls the introduction of the humidity into the keep-fresh container by means of a control element. The keep-fresh container is arranged displaceably in a housing of the domestic refrigeration appliance. One essential concept of the invention can be seen in the fact that a front wall of the keep-fresh container forms an outer wall of the domestic refrigeration appliance. This simplifies access to the keep-fresh container. This is because it is no longer necessary first to open the door for closing the interior compartment in order in principle to be able to access the keep-fresh container and then withdraw said container separately only when the door is open, instead the keep-fresh container itself so-to-speak opens to the outside and can be opened directly without it first being necessary to open a separate door for this.

The keep-fresh container is preferably embodied as a drawer. When the keep-fresh container is in withdrawn state, therefore, this specific embodiment facilitates access from above for a user in a very simple and comprehensive manner. This also enables the insertion or removal of foodstuffs in the keep-fresh container or out of the keep-fresh container to take place ergonomically. Hence, the keep-fresh container can be pulled forward in the depth direction of the domestic refrigeration appliance though a front area of the domestic refrigeration appliance which does not belong to the keep-fresh container. In particular in connection with the embodiment as a drawer, the embodiment according to the invention of a keep-fresh container of this kind means the inserted and hence closed state or position of the keep-fresh container is such that this front wall of the keep-fresh container forms a part of this entire front area of the domestic refrigeration appliance and is present as a so-to-speak exposed visible component.

If this keep-fresh container in the form of a drawer is then pulled outward out of this closed position, unrestricted access from above is provided and not impeded by any other components. Due to the fact that such an embodiment of the keep-fresh container then also enables unlimited lateral access, the invention is particularly advantageous with respect to ease of handling of the keep-fresh container for a user. This is because, even with a slight withdrawal of the keep-fresh container out of its closed end position from above and from the sides, no further component of the domestic refrigeration appliance is in the way and even heavier or larger stored articles or foodstuffs can be grasped simply and securely by a user and removed or introduced.

It is preferably provided that the keep-fresh container comprises a carrier tray on which the front wall is arranged. This forms a mechanically stable embodiment of the keep-fresh container. Precisely when a completely withdrawn state is established and, there is possibly also extensive loading with foodstuffs, the keep-fresh container is very torsion resistant. Both the loading and actuation, and hence displacement, are unrestrictedly possible and jamming or bracing is prevented.

It is preferably provided that the carrier tray comprises a side wall on an upper edge of which a setting element for setting the ambient humidity in the keep-fresh container is arranged. This is a very advantageous position of a setting element of this kind because, due to the unrestricted access from above, even with an only slightly withdrawn keep-fresh container, a user can identify and also actuate the setting element. In addition, the specific position on the upper edge means there is no restriction to any other access required to the area in which the foodstuffs are arranged in the keep-fresh container.

It is preferably provided that the setting element is a setting wheel. This is then simple to actuate and, since the upper edge of the side wall has a certain flat embodiment, a user is able to touch and move the setting element in the form of the setting wheel very accurately with one finger.

It is preferably provided that the setting element is arranged in a front third of the length of the side wall facing the front wall. This further improves the aforementioned advantages. In particular, it is then not necessary to open the keep-fresh container completely so that an unwanted loss of already existing ambient humidity can be avoided when there is to be a further actuation of the setting element.

It is preferably provided that the setting element extends through an opening in a flange of the side wall forming the upper edge and a setting unit comprising the setting element is arranged under the flange on an outer side of the side wall. This is a further very advantageous embodiment, because in this case a setting element does not undesirably protrude greatly above the upper edge. This enables unwanted installation space or an unwanted impact to be avoided on the removal of foodstuffs from the keep-fresh container or on the introduction of foodstuffs into the keep-fresh container. This also minimizes the risk of damage to this setting element. Moreover, this embodiment also provides a certain guidance by this flange or by the walls of this flange bounding the hole. This enables unwanted force impacts, which would result in excessive bending or tilting of the setting element, to be avoided.

Moreover, the position of the setting element directly on the setting unit also provides a compact module with which the movements or actuations of the setting element can be detected and evaluated close to the site. Moreover, it is then also possible for this setting unit to have a compact design and to be arranged in a non-disruptive position. Since a side wall of this kind is per se also very stable, it can be used without restriction as a carrier wall for the setting unit. In this connection, the setting unit can, therefore, also be secured in a very stable way to this side wall and is hence arranged there with a certain degree of protection.

In particular, the setting element and the actuating element are arranged in the setting unit and the setting element is coupled to the actuating element by a coupling device. As a result, the operation of the setting element actuates the actuating element and hence completes the setting of the ambient humidity since the actuation of the actuation element moves a cover of the keep-fresh container relative to a receiving tray of the keep-fresh container and a closed or open state between these two components is established. The coupling device can have a purely mechanical design or even an electrical or magnetic or pneumatic design.

It is in particular advantageous for this side wall to have a C-shape as a sub-area, wherein this setting unit is then arranged in the receiving space formed by the C-shape. An upper roof area of the C-shape is then in particular formed by the flange and a floor area of the C-shape then forms a support for the setting unit. The protected and mechanically stable positioning of the setting unit is then achieved to a particular degree. Moreover, an uneven embodiment of the side wall further increases its resistance to deformation so that here once again improvements are achieved with respect to robustness and mechanical load-bearing capacity.

It is preferably provided that the keep-fresh container comprises a receiving tray for foodstuffs embodied as a separate component. Moreover, the keep-fresh container comprises a cover separate from the receiving tray, which is positioned in a raisable and lowerable manner above the receiving tray. This embodiment can then so-to-speak, according to requirements, form a closed volume which is separate from the rest of the interior compartment in which an ambient humidity different and independent from that in the rest of the interior compartment can be set.

In this context, it is in particular provided that the cover is mounted on internal sides of an interior container of the domestic refrigeration appliance. An actuating mechanism is provided, which can be set in dependence on the movement of the keep-fresh container and hence in dependence on how it is withdrawn or inserted, with which the position of the cover for the receiving tray can be set. This can in particular be provided automatically in dependence on the respective displacement position of the keep-fresh container and hence in particular of the components comprising the front wall and the receiving tray relative to the cover. The actuating mechanism can comprise the aforementioned setting unit.

It is preferably provided that the receiving tray of the keep-fresh container embodied separately from the carrier tray can be inserted into and removed from the carrier tray in a non-destructively detachable manner. Therefore, this embodiment provides for the introduction of foodstuffs in the receiving tray, which are then in turn received in the carrier tray in a mechanically stable manner. With this particular invention, this is a very advantageous embodiment, since on withdrawal from the closed position, it is also possible for high downward leverage forces or weight forces to occur when the keep-fresh container so-to-speak protrudes completely freely frontward. This embodiment is again in particular very advantageous with the design of the keep-fresh container in which its front wall forms a front outer part of the domestic refrigeration appliance. When heavily loaded with foodstuffs, the load-bearing capacity of the keep-fresh container is therefore just as unrestrictedly possible as a smooth-running and hence non-jamming movement of this keep-fresh container.

Moreover, with an embodiment of this kind, it is particularly advantageously possible to remove and clean the receiving tray as a separate part, which also enables high requirements on hygiene to be satisfied. Not least, an embodiment of this kind can also enable loading of the receiving tray with foodstuffs in withdrawn state from the carrier tray so that, in individual cases, optionally very simple and user-specific desired more complete loading with foodstuffs making full utilization of the receiving area of the receiving tray can take place than would be case if the receiving tray were not provided and only the carrier tray were provided or the receiving tray could not be removed from the carrier tray.

It is preferably provided that an actuating element for the actuation of the cover is arranged on the upper edge of the side wall of the carrier tray. The actuating element is in particular mechanically coupled to a coupling element arranged on the cover. Hence, with this embodiment, on the movement of the front wall and the receiving tray, or in particular with the carrier tray, there is an impact on the cover which is then displaced relative to the guide bars arranged on the internal sides of the interior container on which the cover is mounted. This provides a very simple but nevertheless highly functional principle of action in order to be able to position the cover precisely in the respective positions of the keep-fresh container. These components can also be used for the aforementioned actuation device, in particular the actuating mechanism.

It is preferably provided that the actuating element is a pin that can be displaced in the depth direction of the domestic refrigeration appliance. This achieves a very simple and nevertheless robust concept so that the actuation or the impact on the cover movement also takes place in a very secure and reliable manner.

It is preferably provided that the actuating element is arranged on a setting unit arranged under the flange on an outer side of the side wall. The setting unit is in particular one that also comprises a setting element for setting the ambient humidity in the keep-fresh container. This means that a plurality of functional elements is then installed in one module so that once again a compact design is achieved. This also reduces the number of individual components to be reduced.

It is preferably provided that the cover with upright guide elements is coupled to guide bars embodied on the interior container and is displaceable relative to the guide bars. Depending upon the displacement position of the cover with respect to the receiving tray, it is then in a raised state relative to or in a state where it is placed thereupon so that the unit with a cover and a receiving tray is either completely closed or at least partially opened. The individual setting of the ambient humidity can then take place in dependence thereupon.

In one advantageous embodiment, it is provided that the receiving tray comprises at an upper edge a front and rear flange with which the receiving tray is suspended from above on a rear wall and a front edge of the carrier tray of the keep-fresh container from above. This ensures that the receiving tray is, on the one hand, stably positioned above two supporting lines, but, on the other, is simple to remove and insert.

In a further, very advantageous embodiment, it is provided that the keep-fresh container comprises a first keep-fresh container compartment with a first receiving tray and a first cover therefor. The keep-fresh container also comprises at least one second keep-fresh container compartment with a second receiving tray and a second cover therefor. The two receiving trays are arranged or can be inserted next to one another in the horizontal direction of the domestic refrigeration appliance on a plane in the carrier tray. It is furthermore very advantageous that different ambient humidities can be set in these keep-fresh container compartments and the ambient humidities can be set independently of one another in the respective keep-fresh container compartments. This enables the flexibility of the mounting to be further improved while access to a plurality of separate areas of the keep-fresh container is nevertheless possible in a very user-friendly way.

An embodiment of this kind with a plurality of keep-fresh container compartments that are separate from one another enables the individual nature of the storage of the foodstuffs, in particular for foodstuffs which can be kept fresh for longer by means of an individual humidity setting, to be improved. Hence, it is possible for at least two, again different, humidity levels to be set in the interior compartment, namely in the keep-fresh containers, which can be set independently of one another and which then can again be set differently and independently of the humidity level prevailing in the rest of the interior compartment outside the keep-fresh container compartments.

The terms "up", "down", "front", "rear", "horizontal", "vertical", "depth direction", "width-wise direction", "height-wise direction" refer to the positions and orientation with use as specified and the arrangement as specified of the appliance and with a observer standing in front of the appliance looking in the direction of the appliance.

Figure 2:
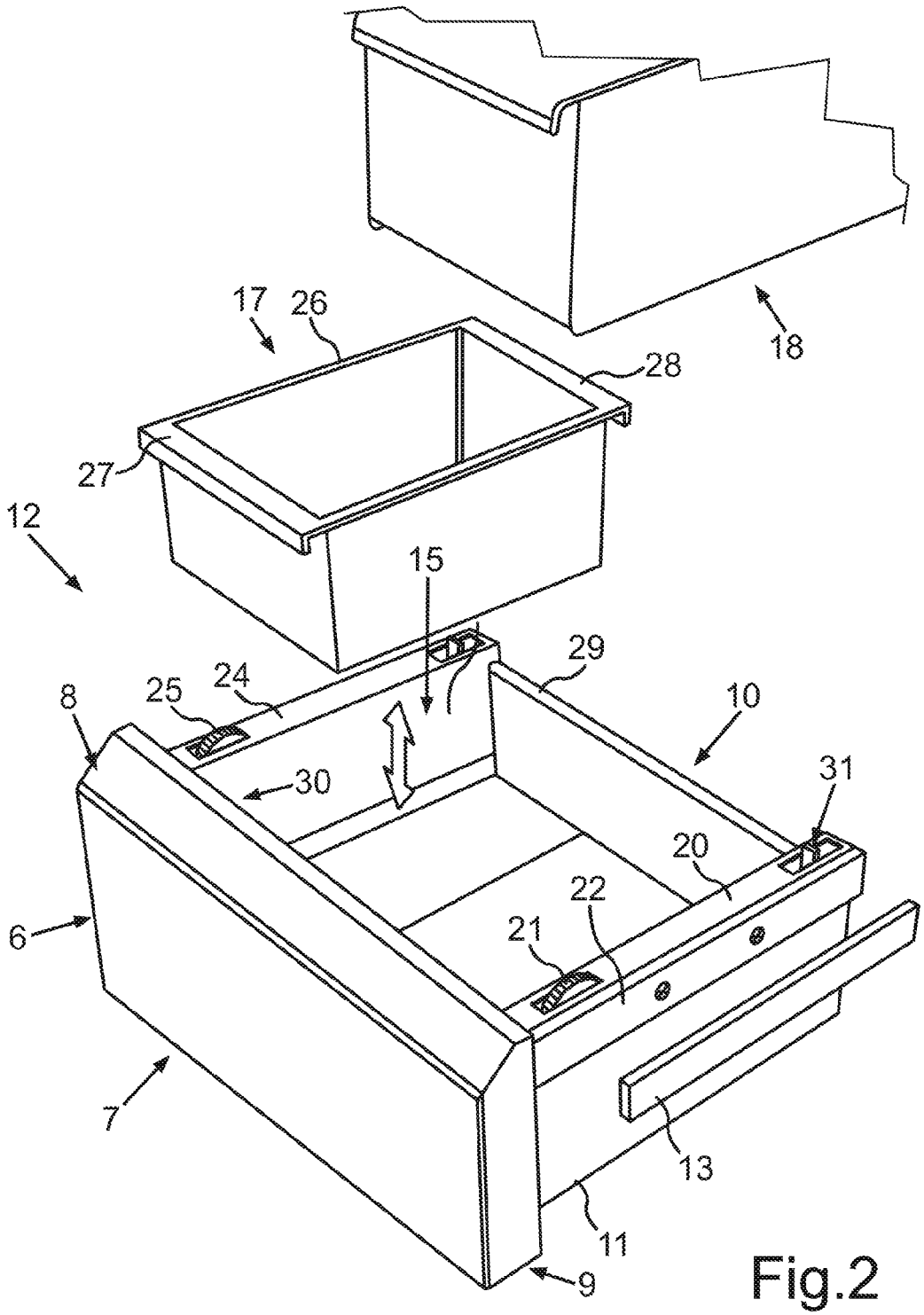
Figure 3:
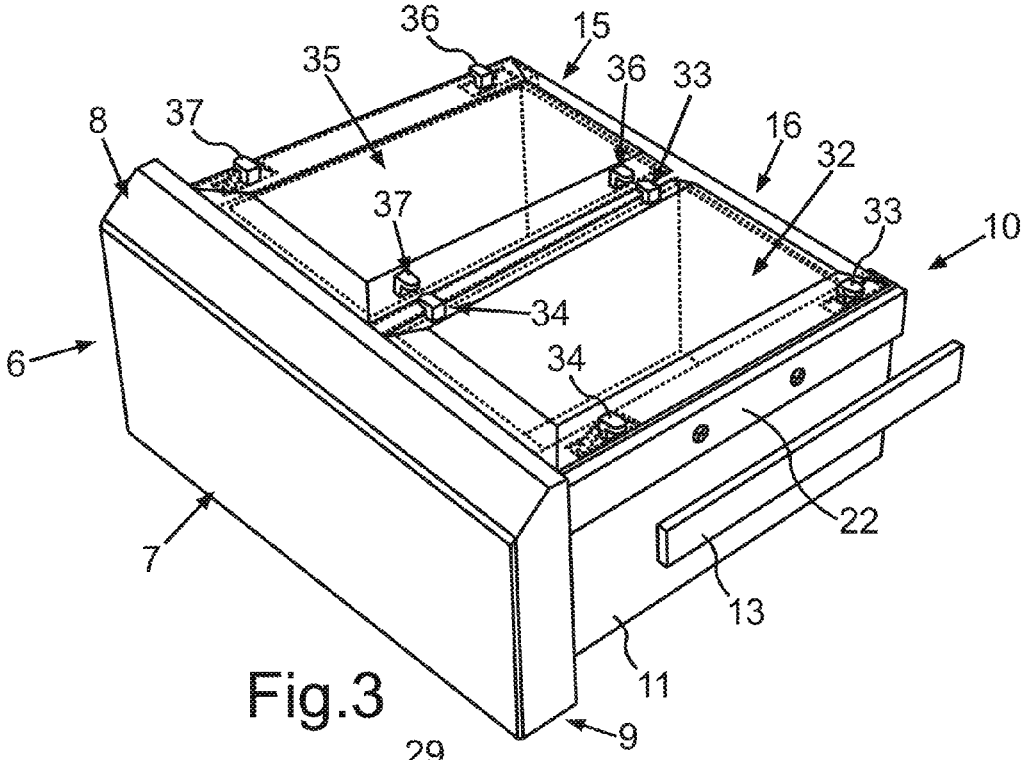
Figure 4:
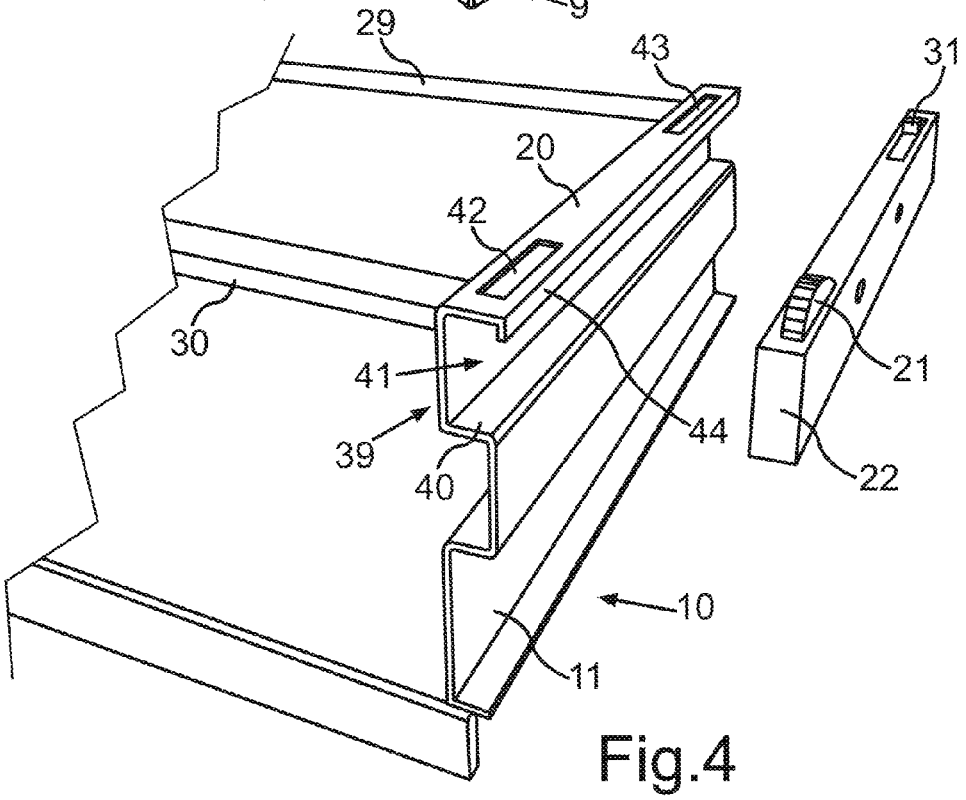
Figure 5:
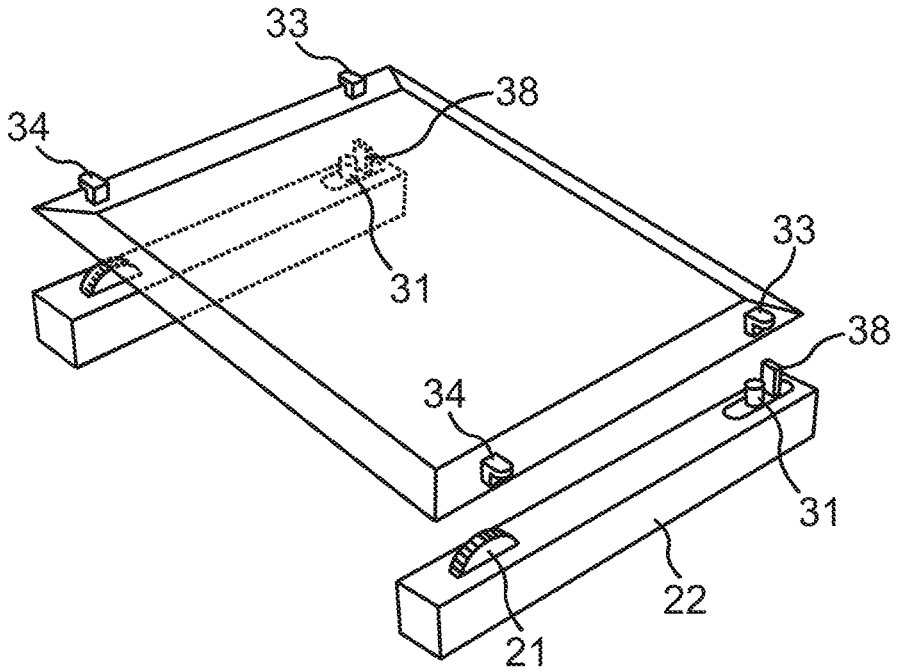
Figure 6:
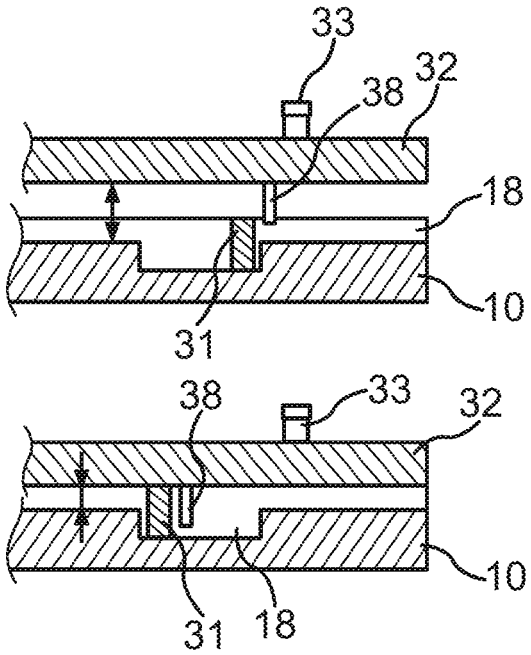

Further features of the invention are apparent from the claims, the figures and the description of the figures. The features and feature combinations mentioned above in the description and the features and feature combinations mentioned below in the description of the figures and/or shown in the figures alone are usable not only in the respectively specified combination, but also in other combinations or in on their own without leaving the scope of invention. Hence, embodiments of the invention that are not explicitly shown and explained in the figures but are derived from separated feature combinations from the embodiments explained and may be generated thereby should also be considered as being comprised and disclosed by the invention. Hence, embodiments and feature combinations which do not comprise all the features of an originally worded independent claim should also be considered to be disclosed. Moreover, embodiments and feature combinations, in particular in the above-described embodiments, which extend beyond or deviate from the feature combinations described in the back-references in the claims should also be considered to be disclosed Exemplary embodiments of the invention are described below with reference to schematic drawings, which show:

FIG. 1 a perspective partial view of an exemplary embodiment of a domestic refrigeration appliance according to the invention;

FIG. 2 an exploded view of an exemplary embodiment of the keep-fresh container as installed in the domestic refrigeration appliance in FIG. 1;

FIG. 3 a view of the keep-fresh container in FIG. 2 in assembled state with additionally shown separate covers of the keep-fresh container compartments;

FIG. 4 a perspective view of a sub-area of the keep-fresh container;

FIG. 5 a further perspective view of a sub-area of the keep-fresh container; and FIG. 6 schematic views of the keep-fresh container in different positional arrangements and an underlying principle of action for the actuation of the cover.

In the figures, identical elements or elements with identical functions are given the same reference numbers.

FIG. 1 is a perspective view of a partial section of a domestic refrigeration appliance 1. The domestic refrigeration appliance 1 is embodied to store foodstuffs and can, for example, be a refrigerator or a combined fridge-freezer.

The domestic refrigeration appliance 1 comprises a body or a housing 2. The housing 2 has an interior compartment 3 into which foodstuffs can be introduced. The interior compartment 3 is partially disposed on the front side and hence, when installed as specified, faces a user and can be closed by at least one door, in the exemplary embodiment two doors 4 and 5.

The domestic refrigeration appliance 1 also comprises a keep-fresh container 6. Foodstuffs, such as food and drinks, can also be introduced into the keep-fresh container 6. An ambient humidity different from that of the rest of the interior compartment 3 can be set in the keep-fresh container 6. The ambient humidity can be set independently of the rest of the interior compartment 3. The keep-fresh container 6 is in particular comprised by the interior compartment 3 or the interior compartment 3 is in the inserted state of the keep-fresh container 6 and closed by a front wall 7 of the keep-fresh container 6.

In particular it is provided that the keep-fresh container 6 is also only partially accommodated in the interior compartment 3. However, the receiving volume provided by the keep-fresh container 6 for the foodstuffs is completely separable or separated from the rest of interior compartment 3 with respect to the setting of the ambient humidity.

It is provided that the keep-fresh container 6 is in particular embodied as a drawer. To this end, in the view in FIG. 1, the keep-fresh container 6 is shown in completely withdrawn state. In this context, it is arranged as a frontward-protruding and freely overhanging component part.

The keep-fresh container 6 comprises a front wall 7 forming an outer wall of the domestic refrigeration appliance 1 in this front area. This means that, even in closed state and hence when the keep-fresh container 6 is completely inserted, this front wall 7 represents an outer part on this front area and hence is visibly exposed. Therefore, even in closed state of the keep-fresh container 6, for access to the keep-fresh container 6, it is no longer necessary first to actuate a further component, for example a door embodied separately from the keep-fresh container 6 and in particular separately from this front wall 7 in order to enable access to the keep-fresh container 6.

In the closed state of the keep-fresh container 6, the front wall 7 is in particular arranged flush with the doors 4 and 5.

It is preferably provided that a grip is embodied on the front wall 7 so that the keep-fresh container 6 is simple to grasp and withdraw and insert. To this end, it is, for example possible, for a grip 8 to be provided in the upper area of the front wall 7. However, it is also additionally or alternatively possible for a grip to be provided on a lower edge 9.

In the exemplary embodiment, the keep-fresh container 6 comprises a carrier tray 10 on the front side of which the front wall 7 is arranged and covers the carrier tray 10.

In the embodiment shown, guide rails 13 are in each case arranged on the outside of the carrier tray 10, in particular on side walls 11 and 12, wherein said guide rails can, for example, also be pull-out rails. These can be used to insert and withdraw the keep-fresh container 6 embodied a drawer in a linear fashion. Corresponding guide elements are arranged on internal sides of an interior container 14 bounding the interior compartment 3.

In the embodiment shown, the keep-fresh container 6 is embodied with two keep-fresh container compartments 15 and 16. This means that the keep-fresh container compartments 15 and 16 each have individual receiving volumes for foodstuffs and ambient humidities that can be different from one another and can also be different from that in the rest of the interior compartment 3 in the keep-fresh container compartments 15 and 16. This setting of the ambient humidities can take place independently of the respective other keep-fresh container compartments and/or independently of the rest of the interior compartment 3.

In the exemplary embodiment, it is moreover also provided that the keep-fresh container compartments 15 and 16 comprise the carrier tray 10 as a common component.

Moreover, the keep-fresh container compartment 15 comprises a receiving tray 17, which is embodied separately from the carrier tray 10 and can be inserted into the carrier tray 10 in a non-destructive detachable manner. FIG. 1 shows the inserted state.

The further keep-fresh container compartment 16 also comprises a receiving tray 18, which is embodied to accommodate foodstuffs, is embodied separately from the carrier tray 10 and in FIG. 1 is shown in a state inserted therein.

Moreover, it is can be identified that the side wall 11 comprises a flange 20 on an upper edge 19. Arranged on the flange 20, there is a setting element 21, which is preferably embodied as a setting wheel and by means of which the ambient humidity in the keep-fresh container compartment 16 can be set. As can be identified, this setting element 21 is arranged in a front third of the side wall 11 when viewed in the depth direction and hence in the z-direction of the domestic refrigeration appliance 1 and hence embodied adjacent to the front wall 7.

The setting element 21 is arranged on a setting unit 22 attached to the side wall 11.

Correspondingly, an upper edge 23 is embodied on the side wall 12, said upper edge comprising a flange 24 on which correspondingly a setting element 25, in particular a setting wheel, is arranged with which the ambient humidity in the keep-fresh container compartment 15 can be set. The embodiment of the setting element 25 otherwise corresponds to the setting element 21, including with respect to a setting unit 22.

FIG. 2 is an exploded view of the keep-fresh container 6 as shown in FIG. 1. In this case, the two receiving trays 17 and 18 are shown in withdrawn state. As can be identified, the receiving tray 17 comprises a front-side flange 27 and a rear-side flange 28 on an upper edge 26. On these opposite flanges 27 and 28, the receiving tray 17 is suspended from above on a rear wall 29 of the carrier tray 10 and a front edge 30 of the carrier tray 10. The receiving tray 18 is also embodied correspondingly.

It can moreover be identified in FIG. 2 that an actuating element 31, preferably embodied as an upright pin, is arranged on the flange 20. This actuating element 31 can be used to actuate a cover 32 belonging to the keep-fresh container compartment 16 (FIG. 3). In this context, the cover 32 can be moved relative to the associated receiving tray 18 and hence raised or lowered. In this context, the cover 32 comprises guide elements 33 and 34 which stand upright on the side facing away from the receiving tray 18 and are embodied in a hook-shape. These guide elements 33 and 34 are mechanically coupled to guide bars arranged on the vertical internal sides of the interior compartment 3. These guide bars preferably do not have a horizontal orientation, but are inclined over a horizontal plane. This enables the cover 32 to be raised or lowered in dependence on the movement of the front wall 7 and the carrier tray 10 and hence also of the receiving tray 18 inserted therein and hence to be positioned either completely on the receiving tray 18 or at a short distance therefrom. In dependence thereon, the respective ambient humidity can then be set in the keep-fresh container compartment 16 and hence in the receiving volume formed by the receiving tray 18 and the cover 32.

As shown in FIG. 3, the keep-fresh container compartment 15 also comprises a cover 35 which correspondingly comprises guide elements 36 and 37. Since the actuating element 31 is a pin 31 oriented in the vertical direction and hence in the y-direction that is displaceable in the horizontal direction and hence in the depth direction, on the insertion of the carrier tray 10, coupling to a coupling element (FIG. 5) takes place and the corresponding movement then causes the cover 32 to be carried or pushed along therewith. This causes it also to be moved by the guide elements 33 and 34 on the mounting apparatus formed by the guide bars and, due to their inclined orientation, the cover hence to be arranged inclined or closed in the horizontal direction on the receiving tray 18.

In each case pairs of opposite rear guide elements 33 and front guide elements 34 are provided as is also correspondingly the case with the cover 35. In particular, as shown in FIG. 5, in each case opposite actuating elements 31 are also provided which are coupled to opposite coupling elements 38.

Therefore, it is advantageously also provided that, in the interior compartment 3, an arrangement of a guide part, preferably oriented in the depth direction, is provided, which is then so-to-speak arranged in the middle between the covers 32 and 35 so that here the corresponding mounting of the cover 32 and the cover 35 is also provided. This can, for example, be a brace, which extends on a front crossbar 44 (FIG. 1) to a rear wall of the interior container 14 and attached thereto in each case at the ends.

FIG. 4 is a perspective partial view of the carrier tray 10. As can be identified here, the side wall 11 is uneven and C-shaped 39 in its upper area. Here, a C-roof is formed by the flange 20 and a C-floor 40 provided opposite. This forms a receiving area 41 in which the setting unit 22 is arranged. As can be identified, a hole 42 is embodied in the flange 20 through which hole the setting element 21 extends. Correspondingly, a further hole 43 is formed through which the actuating element 31 extends.

In this embodiment, the flange 20 comprises an additional bar 44, which is downward-oriented on its outward free end so that, in inserted state, the setting unit 22 in the receiving area 41 is also held in position outwardly. In the view shown in FIG. 4, the front wall 7 is not shown for purposes of clarity.

FIG. 6 is a simplified side view of the mechanical principle of action. The setting unit 22 provides a coupling between the rotary motion or the actuation of the setting element 21 with the actuating element 31. This means that, when the setting element 21 is moved, in particular rotated, a coupling device, in particular a coupling mechanism, in the setting unit 22 displaces the actuating element 31 toward the front or toward the rear. As a result, the coupling with coupling elements 38 causes the cover 32 to be moved out of its guide bars in which the guide elements 33 and 34 are guided, in particular lie. Hence, a movement of the cover 32 relative to the receiving tray 18 effected by the setting element 21 takes place. The embodiment of guide bars, in particular with notch-like receptacles, then enables the cover to be raised or lowered, wherein the guide elements 33 and 34 are then either arranged within these notch-like receptacles, and then the cover 32 lies completely closed on the receiving tray 18, or are arranged outside these notch-like receptacles are and hence the cover 32 is then raised upward with respect to the receiving tray 18 and no longer lies thereon as to provide a complete seal.

It is in particular provided, as shown in FIG. 6 that, in its possible linear displacement movement, when the actuating element 31 is positioned right at the front and hence arranged closer to the front wall 7, the cover 32 is in its lowered position and hence sits in its completely sealing arrangement on the receiving tray 18. This shown is in the bottom view in FIG. 6.

If this actuating element 31 is located in the position which is then displaced toward the rear, as shown in the upper view in FIG. 6, during this pushing back, the actuating element 31 presses against the coupling element 38 and hence also displaces the entire cover 32 toward the rear so that the guide elements 33 and 34 on the guide bars are guided along and raised out of the notch-like receptacles.

LIST OF REFERENCE NUMBERS

1 Domestic refrigeration appliance
2 Housing
3 Interior compartment
4 Door
5 Door
6 Keep-fresh container
7 Front wall
8 Grip
9 Lower edge
10 Carrier tray
11 Side wall
12 Side wall
13 Guide rail
14 Interior container
15 Keep-fresh container compartment
16 Keep-fresh container compartment
17 Receiving tray
18 Receiving tray
19 Upper edge
20 Flange
21 Setting element
22 Setting unit
23 Upper edge
24 Flange
25 Setting element
26 Upper edge
27 Front flange
28 Rear flange
29 Rear wall
30 Front edge
31 Actuating element
32 Cover
33 Guide element
34 Guide element
35 Cover
36 Guide element
37 Guide element
38 Coupling element
39 C-shape
40 C-floor
41 Receiving area
42 Hole
43 Hole
44 Bars
45 Crossbar

The invention claimed is:

1. A domestic refrigeration appliance with an interior compartment for accommodating foodstuffs which is bounded by walls of an interior container and with a keep-fresh container for foodstuffs in which an ambient humidity different from that of the interior compartment can be set and the ambient humidity can be set independently of the rest of the interior compartment, wherein the keep-fresh container is arranged displaceably in a housing of the domestic refrigeration appliance, wherein a front wall of the keep-fresh container forms an outer wall of the domestic refrigeration appliance, wherein the keep-fresh container comprises a carrier tray on which the front wall is arranged, and wherein the carrier tray comprises a side wall on an upper edge of which a setting element for setting the ambient humidity in the keep-fresh container is arranged.

2. The domestic refrigeration appliance as claimed in claim 1, wherein the keep-fresh container is embodied as a drawer.

3. The domestic refrigeration appliance as claimed in claim 1, wherein the setting element is a setting wheel.

4. The domestic refrigeration appliance as claimed in claim 1, wherein the setting element is arranged in a front third of the length of the side wall facing the front wall.

5. The domestic refrigeration appliance according to claim 1, wherein the setting element extends through an opening in a flange of the side wall forming the upper edge and a setting unit comprising the setting element is arranged under the flange on an outer side of the side wall.

6. The domestic refrigeration appliance according to claim 1, wherein the keep-fresh container comprises a receiving tray for foodstuffs and a cover separate thereto positioned in a raisable and lowerable manner above the receiving tray.

7. The domestic refrigeration appliance as claimed in claim 1, wherein a receiving tray embodied separately from the carrier tray can be inserted into and removed from the carrier tray in a non-destructive detachable manner.

8. The domestic refrigeration appliance as claimed in claim 1, wherein an actuating element for the actuation of a cover is arranged on the upper edge, said element being coupled to a coupling element on the cover.

9. The domestic refrigeration appliance as claimed in claim 8, wherein the actuating element is a pin that can be displaced in the depth direction of the domestic refrigeration appliance.

10. The domestic refrigeration appliance as claimed in claim 8, wherein the actuating element is arranged on a setting unit, which is arranged under at least one of a flange on an outer side of the side wall and the actuating element is coupled to the setting element.

11. The domestic refrigeration appliance as claimed in claim 6, wherein the receiving tray comprises at an upper edge a front-side and a rear side flange with which the receiving tray is suspended from above on a rear wall and a front edge of the carrier tray.

12. The domestic refrigeration appliance according to claim 1, wherein the keep-fresh container comprises a first keep-fresh container compartment with a first receiving tray and a first cover therefor and a second keep-fresh container compartment with a second receiving tray and second cover therefor, wherein the receiving trays are arranged next to one another in the horizontal direction on a plane in the carrier tray and different ambient humidities can be set in the keep-fresh container compartments and the ambient humidities can be set independently of one another.

13. A domestic refrigeration appliance with an interior compartment for accommodating foodstuffs which is bounded by walls of an interior container and with a keep-fresh container for foodstuffs in which an ambient humidity different from that of the interior compartment can be set and the ambient humidity can be set independently of the rest of the interior compartment, wherein the keep-fresh container is arranged displaceably in a housing of the domestic refrigeration appliance, wherein a front wall of the keep-fresh container forms an outer wall of the domestic refrigeration appliance, wherein the keep-fresh container comprises a carrier tray on which the front wall is arranged, wherein an actuating element for the actuation of a cover is arranged on an upper edge of the carrier tray, said element being coupled to a coupling element on the cover, wherein the cover with upright guide elements is supported on the interior container and is displaceable by the actuating element and, depending upon the displacement position of the actuating element, is raised with respect to the receiving tray or placed thereupon.

14. The domestic refrigeration appliance according to claim 13, wherein the actuating element is settable between a first position and a second position, wherein when the keep fresh container is closed and the actuating element is in the first position the cover is raised with respect to the receiving tray, and wherein when the keep fresh container is closed and the actuating element is in the second position, the cover is placed upon the receiving tray.

15. The domestic refrigeration appliance according to claim 13, wherein the cover is supported on a vertical internal side of the interior container.

* * * * *